US010134375B2

(12) United States Patent
Kakehashi et al.

(10) Patent No.: US 10,134,375 B2
(45) Date of Patent: Nov. 20, 2018

(54) ELECTRONIC PERCUSSION

(71) Applicant: ATV corporation, Hamamatsu-shi, Shizuoka (JP)

(72) Inventors: Ikutaro Kakehashi, Shizuoka (JP); Tsutomu Tanaka, Shizuoka (JP)

(73) Assignee: ATV corporation, Shizuoka (JP)

( * ) Notice: Subject to any disclaimer, the term of this patent is extended or adjusted under 35 U.S.C. 154(b) by 0 days.

(21) Appl. No.: 15/564,692

(22) PCT Filed: Mar. 17, 2017

(86) PCT No.: PCT/JP2017/010885
§ 371 (c)(1),
(2) Date: Oct. 5, 2017

(87) PCT Pub. No.: WO2017/175566
PCT Pub. Date: Oct. 12, 2017

(65) Prior Publication Data

US 2018/0197516 A1 Jul. 12, 2018

(30) Foreign Application Priority Data

Apr. 8, 2016 (JP) ..... 2016-077812

(51) Int. Cl.
*G10H 3/14* (2006.01)
*G10H 1/32* (2006.01)
*G10H 1/00* (2006.01)

(52) U.S. Cl.
CPC ..... *G10H 3/146* (2013.01); *G10H 1/00* (2013.01); *G10H 1/32* (2013.01);
(Continued)

(58) Field of Classification Search
CPC ..... G10H 3/146; G10H 1/32; G10H 2220/525
(Continued)

(56) References Cited

U.S. PATENT DOCUMENTS 6,601,436 B1 8/2003 Senda et al.
8,563,843 B1 * 10/2013 Shemesh ..... G10H 7/00 84/723
(Continued)

FOREIGN PATENT DOCUMENTS

JP 07-295561 11/1995
JP 2004-198657 7/2004
(Continued)

OTHER PUBLICATIONS

International Search Report dated May 30, 2017 filed in PCT/JP2017/010885.

*Primary Examiner* — David Warren
*Assistant Examiner* — Christina Schreiber
(74) *Attorney, Agent, or Firm* — Rankin, Hill & Clark LLP

(57) ABSTRACT

To provide an electronic percussion that ensures reproducing further faithful musical sound relative to a hitting operation by a player. An electronic percussion 100 includes a thin plate-shaped head 101 at an opening formed into a shape of a cylinder with a closed bottom and respective pressure sensor 106 and signal processing device 110 on a bottom 102*a*. A surface of the head 101 constitutes a struck surface 101*a*. The head 101 includes a vibration sensor 103 on the back surface. The vibration sensor 103 includes a pressure sensor pressing body 105 on the pressure sensor 106 side. The pressure sensor pressing body 105 is formed to have a tapered shape whose outer diameter gradually thins from the vibration sensor 103 side to the pressure sensor 106 side. The signal processing device 110 outputs a musical sound signal representing a musical sound using respective detection signals of the vibration sensor 103 and the pressure sensor 106.

9 Claims, 4 Drawing Sheets

(52) U.S. Cl.
CPC . *G10H 2220/525* (2013.01); *G10H 2220/561* (2013.01); *G10H 2230/285* (2013.01)

(58) Field of Classification Search
USPC ..... 84/730
See application file for complete search history.

(56) References Cited

U.S. PATENT DOCUMENTS 9,006,555 B2 * 4/2015 Mori ..... G10H 3/14 84/104
9,460,699 B2 * 10/2016 Kanayama ..... G10H 3/146
9,741,324 B2 * 8/2017 Baldwin, Sr. ..... G10D 13/024
9,947,307 B2 * 4/2018 Takasaki ..... G10D 13/024
10,019,976 B1 * 7/2018 Tanaka ..... G10H 1/32
2004/0118269 A1 * 6/2004 Yoshino ..... G10H 3/146 84/723
2004/0149120 A1 * 8/2004 Maruhashi ..... G10D 13/024 84/411 R
2007/0051231 A1 * 3/2007 Fujii ..... G10D 13/024 84/723
2009/0000464 A1 * 1/2009 Mishima ..... G10H 1/0008 84/724
2009/0229450 A1 9/2009 Hashimoto
2010/0064881 A1 * 3/2010 Takehisa ..... G10H 3/146 84/609
2013/0152768 A1 * 6/2013 Rapp ..... G10H 3/125 84/634
2013/0180388 A1 * 7/2013 Mori ..... G10H 3/14 84/723
2016/0225361 A1 * 8/2016 Muzzio ..... G10H 3/146
2017/0116972 A1 * 4/2017 Yoshino ..... G10H 1/32
2017/0236505 A1 * 8/2017 Takasaki ..... G10D 13/024 84/723
2018/0061388 A1 * 3/2018 Takasaki ..... G10H 1/32
2018/0197516 A1 * 7/2018 Kakehashi ..... G10H 3/146

FOREIGN PATENT DOCUMENTS

JP 2009-186886 8/2009
JP 2010-224330 10/2010
JP 2013-142872 7/2013
JP 2014-130373 7/2014

* cited by examiner

ELECTRONIC PERCUSSION

TECHNICAL FIELD

The present invention relates to an electronic percussion that detects an impact to a struck surface beaten by a hand, a stick, or the like to generate an electronic musical sound.

BACKGROUND ART

Conventionally, there has been provided an electronic percussion that detects an impact to a struck surface beaten by a hand, a stick, or the like to generate an electronic musical sound. For example, the following Patent Literature 1 discloses an electronic drum (an electronic percussion). This electronic drum (this electronic percussion) includes both a vibration pickup (a vibration sensor) and a pressure sensor on a back side surface of a hit surface (a struck surface) beaten by the hand or the like. These members detect both a vibration and a pressure on the hit surface to generate an electronic musical sound.

CITATION LIST

Patent Literature

PATENT LITERATURE 1: JP-A-2010-224330

However, the electronic drum type electronic percussion described in Patent Literature 1 has the following problem. That is, the vibration sensor and the pressure sensor are disposed at positions different from one another on the back side of the struck surface. Specifically, while the vibration pickup is disposed at the edge portion of the hit surface, the pressure sensor is disposed at the center of the hit surface. The vibration sensor and the pressure sensor detect the change in the struck surface at the positions different from one another. This loses an integrated correspondence relationship between the detected vibration value and the detected pressure value, making a faithful reproduction of a musical sound based on the hitting difficult. In view of this, a player feels a sense of discomfort to a reproduced sound relative to the hitting operation.

The present invention has been made to deal with the problem. An object of the present invention is to provide an electronic percussion that can reproduce further faithful musical sound relative to the hitting operation by the player.

SUMMARY OF INVENTION

To achieve the object, as a feature of the present invention, a head, a vibration sensor, a pressure sensor, a pressure sensor supporting body, and a pressure sensor pressing body are included. The head constitutes a struck surface beaten by a player. The vibration sensor is disposed at a back surface side opposite to the struck surface at the head. The vibration sensor is configured to detect a vibration of the head. The pressure sensor is disposed opposed to the vibration sensor at a side opposite to the head. The pressure sensor is configured to detect a pressure received by the head. The pressure sensor supporting body is disposed at a side opposite to the vibration sensor with respect to the pressure sensor. The pressure sensor supporting body supports the pressure sensor. The pressure sensor pressing body is disposed between the vibration sensor and the pressure sensor or between the pressure sensor and the pressure sensor supporting body. The pressure sensor pressing body presses the pressure sensor.

With the feature of the present invention thus configured, with the electronic percussion, the vibration sensor and the pressure sensor are disposed between the head and the pressure sensor supporting body directly or indirectly stacked via the pressure sensor pressing body. This allows detecting the vibration and a pressure change occurred in the head by a hitting operation by a player at the identical position under the struck surface. In view of this, a further faithful musical sound can be reproduced relative to the hitting operation by the player.

Another feature of the present invention is as follows. With the electronic percussion, the pressure sensor pressing body is constituted of an elastic body that elastically deforms according to a pressure.

With the other feature of the present invention thus configured, with the electronic percussion, the pressure sensor pressing body is constituted of the elastic body that elastically deforms according to the pressure. In view of this, since the pressure sensor pressing body elastically contacts the pressure sensor, damage of the pressure sensor can be prevented. Furthermore, a vibration from the vibration sensor or the pressure sensor supporting body decays; therefore, accuracy to detect the pressure by the pressure sensor can be improved.

Another feature of the present invention is as follows. With the electronic percussion, the pressure sensor pressing body has an area of a part pressing the pressure sensor smaller than an area of the pressure sensor.

With the other feature of the present invention thus configured, with the electronic percussion, the pressure sensor pressing body has the area of the part pressing the pressure sensor smaller than the area of the pressure sensor and therefore the pressure sensor pressing body partially contacts the pressure sensor. This ensures preventing a saturation of a detected value simultaneous with an input of the pressure. With the electronic percussion, with the pressure sensor pressing body constituted of the elastic body, a contacted area (a pressing area) of the pressure sensor pressing body to the pressure sensor increases according to the pressure. This ensures improving a detection width (so-called dynamic range) of the pressure and detection resolution.

With the other feature of the present invention, with the electronic percussion, the pressure sensor pressing body has an area of one end at a side pressing the pressure sensor smaller than an area of an end at another side. The other side is the vibration sensor side or the pressure sensor supporting body side. In this case, for example, the pressure sensor pressing body can be formed into a tapered shape whose lateral cross-sectional surface decreases from the vibration sensor side or the pressure sensor supporting body side to the pressure sensor side.

With the other feature of the present invention thus configured, with the electronic percussion, the pressure sensor pressing body has the area of the one end at the side pressing the pressure sensor smaller than the area of the end at the other side. The other side is the vibration sensor side or the pressure sensor supporting body side. This allows detecting a slight warp and deformation of the head by a wide region and concentratedly transmitting the warp and the deformation to the pressure sensor. This ensures improving detection accuracy of the pressure.

With the other feature of the present invention, with the electronic percussion, the vibration sensor and the pressure sensor are disposed at a center of the head.

With the other feature of the present invention thus configured, with the electronic percussion, the vibration sensor and the pressure sensor are disposed at a center of the struck surface. The center of the struck surface is a part where the vibration appears the largest in the head. Furthermore, the center of the struck surface has a distance from a hit point by the player by a radius of the struck surface at the maximum. In view of this, the vibration and the pressure can be accurately detected.

With the other feature of the present invention, with the electronic percussion, the pressure sensor pressing body is not fixedly secured to but in contact with a surface of the pressure sensor.

With the other feature of the present invention thus configured, with the electronic percussion, the pressure sensor pressing body is not fixedly secured to but in contact with the surface of the pressure sensor. Accordingly, even if a force of separating the pressure sensor pressing body from the pressure sensor acts on the pressure sensor pressing body, this feature prevents the pressure sensor pressing body from pulling the pressure sensor. This ensures preventing the damage of the pressure sensor and also ensures improving the detection accuracy of the pressure.

With the other feature of the present invention, with the electronic percussion, the pressure sensor pressing body is disposed between the vibration sensor and the pressure sensor. Between the pressure sensor and the pressure sensor supporting body, a pressure sensor receiving body is provided. The pressure sensor receiving body is constituted of an elastic body that elastically deforms according to a pressure.

With the other feature of the present invention thus configured, with the electronic percussion, the pressure sensor pressing body is disposed between the vibration sensor and the pressure sensor. Between the pressure sensor and the pressure sensor supporting body, the pressure sensor receiving body is provided. The pressure sensor receiving body is constituted of the elastic body that elastically deforms according to the pressure. Accordingly, the pressure sensor is elastically supported. This ensures preventing the damage of the pressure sensor and also restraining transmission of a harmful vibration, ensuring improving the detection accuracy of the pressure. With the electronic percussion, differentiating an elastic force of the pressure sensor pressing body and an elastic force of the pressure sensor receiving body from one another allows changing a detection property of the pressure by the pressure sensor.

With a feature of the present invention, with the electronic percussion, the vibration sensor is supported by a vibration sensor supporting body, the vibration sensor being separated from the head.

With the feature of the present invention thus configured, with the electronic percussion, the vibration sensor is supported by the vibration sensor supporting body, the vibration sensor being separated from the head. Accordingly, when the player beats the proximity of the vibration sensor including the right above the vibration sensor on the struck surface, this feature can restrain the damage of the vibration sensor and also can prevent deterioration of the detection accuracy.

With the feature of the present invention, with the electronic percussion, the pressure sensor supporting body includes a displacement mechanism that changes a distance between the pressure sensor pressing body and the pressure sensor.

With the feature of the present invention thus configured, with the electronic percussion, the pressure sensor supporting body includes the displacement mechanism that changes the distance between the pressure sensor pressing body and the pressure sensor. In view of this, changing the distance between the pressure sensor pressing body and the pressure sensor can adjust the detection properties of the pressure sensor such as detection sensitivity and the detection width of the pressure.

DESCRIPTION OF EMBODIMENTS

Figure 1:
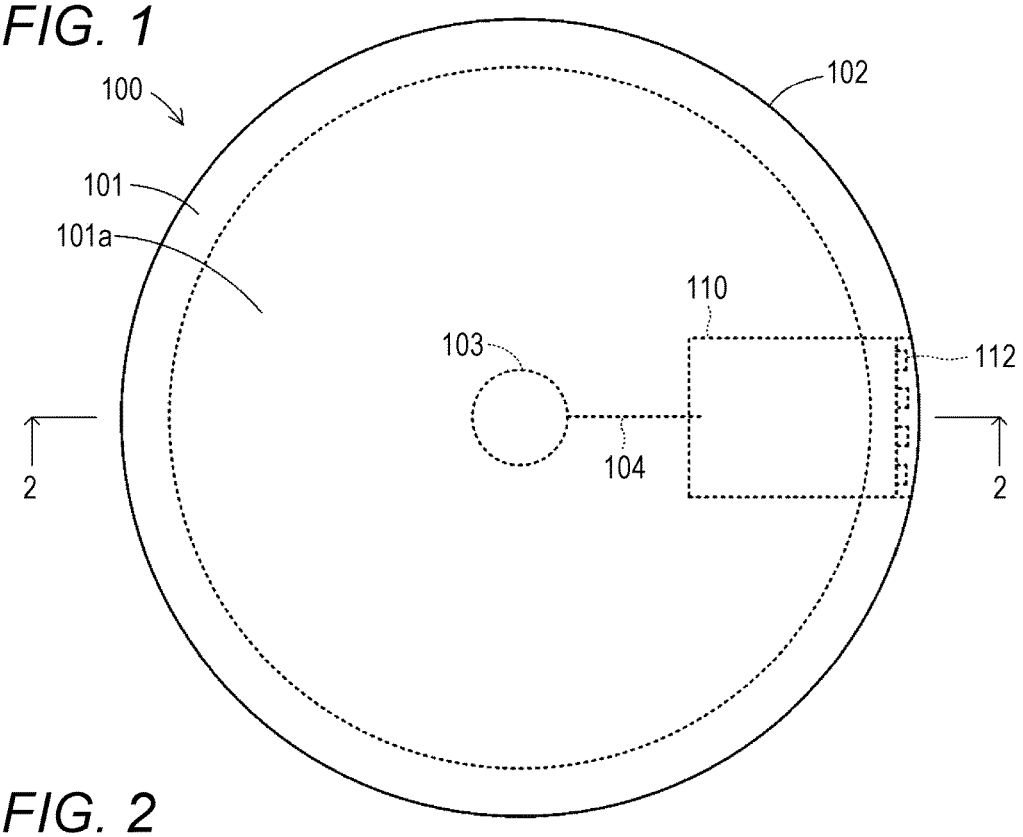
FIG. 1 is a plan view schematically illustrating a schematic external configuration of an electronic percussion according to one embodiment of the present invention.
Figure 2:
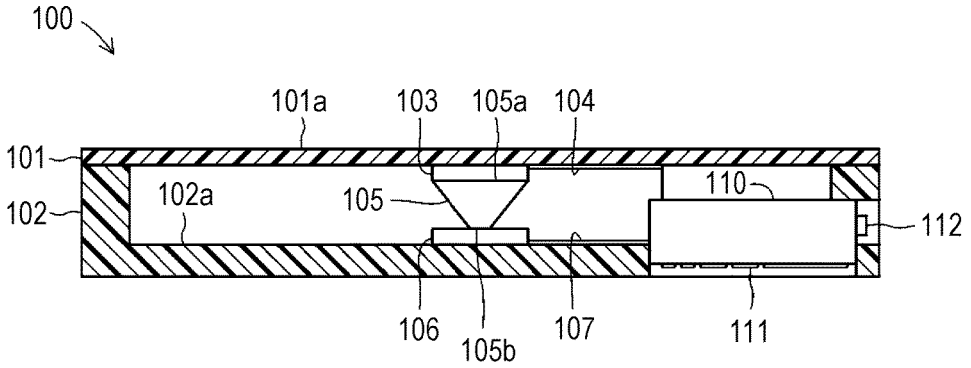
FIG. 2 is a cross-sectional view schematically illustrating a schematic internal configuration of the electronic percussion viewed from line 2-2 illustrated in FIG. 1.

The following describes one embodiment of an electronic percussion according to the present invention with reference to the drawings. FIG. 1 is a plan view schematically illustrating a schematic external configuration of an electronic percussion 100 according to the present invention. FIG. 2 is a cross-sectional view schematically illustrating a schematic internal configuration of the electronic percussion 100 viewed from line 2-2 illustrated in FIG. 1. The drawings to be referred in this description are schematically illustrated for ease of understanding of the present invention by exaggeratedly illustrating a part of components and the like. Therefore, dimensions, ratios, and the like between the respective components may differ. This electronic percussion 100 is an electronic drum that detects an impact to a struck surface 101*a* beaten by a hand of a player (not illustrated) to generate an electronic musical sound.

(Configuration of Electronic Percussion 100)

The electronic percussion 100 includes a head 101. The head 101 is a component that vibrates and elastically deforms by a beating operation and a rubbing operation by the player. The head 101 is configured by forming an elastic plate-shaped body into a circular shape in a plan view. The head 101 of this embodiment is configured by forming a resin material into a thin plate shape. Note that the head 101 can be formed into a film shape using a material such as a synthetic fiber or a natural leather material.

This head 101 has the struck surface 101*a* on one surface. The struck surface 101*a* is a part beaten and rubbed by the hand of the player or a stick. The struck surface 101*a* is formed into a planar shape. A vibration sensor 103 is disposed at the center of the other surface of the head 101, namely, a back surface of the struck surface 101*a*. Furthermore, a peripheral edge portion of this back surface is fixedly secured to a trunk 102.

The trunk 102 with a closed-bottomed cylindrical shape is a component that supports the head 101 and houses respective vibration sensor 103, pressure sensor pressing body 105, pressure sensor 106, and signal processing device 110. With this embodiment, the trunk 102 is made of a resin material. Note that the trunk 102 can be made of a material other than the resin material, for example, a metal material. This trunk 102 securely supports the head 101 to an end of the tubular portion. Furthermore, the trunk 102 securely supports the respective pressure sensor 106 and signal processing device 110 to a bottom 102*a*.

The vibration sensor 103 is a detector that detects vibrations of the head 101. The vibration sensor 103 outputs an electric signal according to the vibration of the head 101 to the signal processing device 110. With this embodiment, the vibration sensor 103 is constituted of a piezo element. This vibration sensor 103 is fixedly secured to the center on the back surface of the head 101 with a double-sided adhesive tape, an adhesive, or the like (not illustrated). In this case, the center of the head 101 is the center position of the circle of the head 101, which is formed into the circular shape in a plan view. Note that the center of the head 101 does not strictly mean only the center position of the circle but means the center portion of the head 101 including the peripheral area of the center position.

A signal line 104 transmits a detection signal output from the vibration sensor 103 to the signal processing device 110. This signal line 104 is also fixedly secured to the back surface of the head 101 with the adhesive. This vibration sensor 103 includes the pressure sensor pressing body 105 on a surface opposite to the surface pasted to the head 101.

Figure 3:
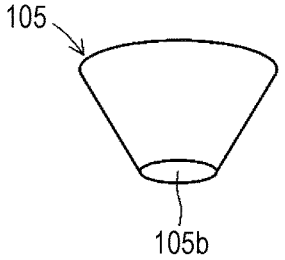
FIG. 3 is a perspective view illustrating an external configuration of a pressure sensor pressing body illustrated in FIG. 2 viewed from a lower side (a pressure sensor side).

The pressure sensor pressing body 105 is a component to press the pressure sensor 106 according to warp and deformation of the head 101. The pressure sensor pressing body 105 is configured by forming an elastic material into a columnar shape. More specifically, as illustrated in FIG. 3, the pressure sensor pressing body 105 is formed into a tapered shape whose outer diameter gradually thins from the vibration sensor 103 side to the pressure sensor 106 side. The pressure sensor pressing body 105 of this embodiment is made of a rubber material. The pressure sensor pressing body 105 has an end 105*a* on the vibration sensor 103 side so as to have the outer diameter approximately identical to the outer diameter of the vibration sensor 103. Additionally, the pressure sensor pressing body 105 has an end 105*b* on the pressure sensor 106 side so as to have the outer diameter with a size one-third of the outer diameter of the pressure sensor 106. This pressure sensor pressing body 105 is fixedly secured to the vibration sensor 103 with the double-sided adhesive tape, the adhesive, or the like (not illustrated).

The pressure sensor 106 is a detector that detects a pressure received due to the warp and the deformation of the head 101. The pressure sensor 106 outputs the electric signal according to the magnitude of the pressure to the signal processing device 110. The pressure sensor 106 of this embodiment is constituted of a high polymer pressure film whose resistance value changes according to the pressure. This pressure sensor 106 is fixedly secured on the bottom 102*a* of the trunk 102 with the double-sided adhesive tape, the adhesive, and the like (not illustrated) while the center position of the detection area of the pressure is positioned on an axis line of the pressure sensor pressing body 105. In this case, the end 105*b*, which is the distal end of the pressure sensor pressing body 105, is not fixedly secured to but in contact with the surface of the pressure sensor 106.

That is, the pressure sensor 106 is disposed opposed to the vibration sensor 103 via the pressure sensor pressing body 105. The center position of the detection area of the pressure in the pressure sensor 106 is the center position of the circle of the pressure sensor 106, which is formed into the circular shape in a plan view. Note that this center position does not strictly mean the center position of the circle but means the center portion of the pressure sensor 106 including the peripheral area of the center position. A signal line 107 transmits a detection signal output from the pressure sensor 106 to the signal processing device 110. This signal line 107 is also fixedly secured to the bottom 102*a* of the trunk 102 with the adhesive.

The signal processing device 110 is an electronic circuit and constituted of a microcomputer constituted of a CPU, a ROM, a RAM, and the like. The signal processing device 110 outputs a musical sound signal based on the detection signal output from the vibration sensor 103 and the detection signal output from the pressure sensor 106. More specifically, the signal processing device 110 executes a control program preliminarily stored on a storage device such as the ROM. Accordingly, the signal processing device 110 generates the musical sound signal representing the musical sound based on the detection signal output from the vibration sensor 103 and changes the musical sound signal using the detection signal output from the pressure sensor 106.

For example, the signal processing device 110 extracts a signal at a resonance frequency matching a preset resonance frequency and a signal at a harmonic of this resonance frequency from the detection signals input from the vibration sensor 103 as the musical sound signals. Afterwards, the signal processing device 110 uses the detection signal input from the pressure sensor 106 to change a musical interval (including a pitch), a sound volume, a timbre, a vibrato, a tremolo, a mute, or a decay control (a decay time of the signal) in the musical sound signal.

The signal processing device 110 can include a PCM sound source circuit that stores a signal representing the musical sound of the actual musical instrument (also referred to as "an acoustic musical instrument") preliminarily recorded by a pulse code modulation (PCM) method. In this case, the signal processing device 110 can also perform a superimposed output on the musical sound signal according to the detection signal input from the vibration sensor 103. Accordingly, the signal processing device 110 can generate the musical sound signal to emit the musical sound close to the musical sound by the acoustic musical instrument.

This signal processing device 110 is fixedly secured on the bottom 102*a* of the trunk 102 with a screw (not illustrated). At this time, an operation panel 111 to input an instruction from the player is exposed from a lower surface of the bottom 102*a* of the trunk 102. Additionally, an output terminal 112 to take out the musical sound signal is exposed to a side surface portion of the trunk 102. Accordingly, the electronic percussion 100 can generate the musical sound according to the preference of the player by an instruction from the player. Furthermore, an electrical connection of the output terminal 112 to an external speaker (not illustrated) allows the electronic percussion 100 to generate the musical sound.

This electronic percussion 100 includes a power supply with a power supply cord (not illustrated). The power supply introduces electric power from a household power source to supply the electric power to the signal processing device 110. Since not directly related to the present invention, the explanation of these is omitted. With this embodiment, the electronic percussion 100 is configured to be a so-called external type that externally couples a speaker generating the musical sound. However, obviously, the electronic percussion 100 may be configured to be a built-in type including a speaker in the trunk 102.

(Operation of Electronic Percussion 100)

The following describes the operation of the electronic percussion 100 thus configured. First, the player prepares the respective electronic percussion 100 and external speaker (not illustrated). Afterwards, the player electrically connects the electronic percussion 100 to the external speaker via the output terminal 112. Next, after powering-ON the electronic percussion 100, the player operates the operation panel 111 to set the signal processing device 110 in a performance mode in which the electronic percussion 100 can give a performance. Accordingly, the signal processing device 110 enters a state in which the signal processing device 110 detects the vibrations of the head 101 and outputs the musical sound.

Figure 4:
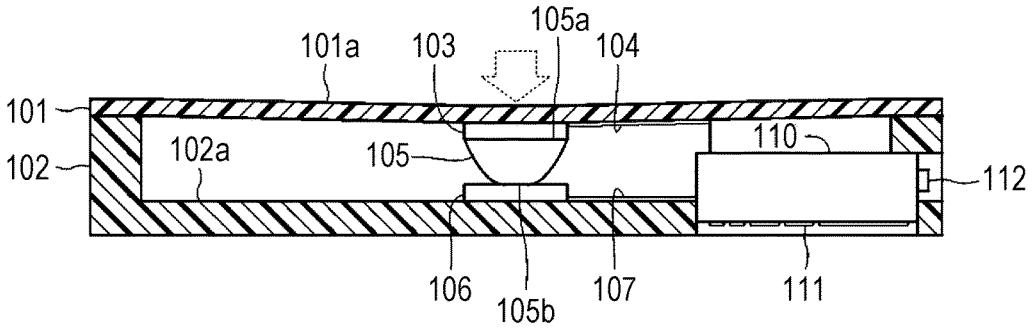
FIG. 4 is a side view illustrating a state where a head of the electronic percussion illustrated in FIG. 2 warps and deforms and a distal end of the pressure sensor pressing body is squashed.

Next, the player gives the performance by beating or rubbing the struck surface 101*a* of the head 101 by the hand while gripping the electronic percussion 100 by one hand or holding the electronic percussion 100 to a stand. Thus, as illustrated in FIG. 4, the head 101 of the electronic percussion 100 vibrates, warps, and deforms according to the performance operation by the player. Accordingly, with the electronic percussion 100, the vibration sensor 103 detects the vibrations of the head 101 and outputs the detection signal according to the vibration to the signal processing device 110. Furthermore, the pressure sensor 106 detects the pressure while the head 101 warps and deforms and outputs the detection signal according to the magnitude of the pressure to the signal processing device 110. FIG. 4 illustrates the force applied to the head 101 by the dashed arrow.

In this case, the pressure sensor pressing body 105 decays the vibration of the head 101 transmitted via the vibration sensor 103. Additionally, the pressure sensor pressing body 105 squashes to deform the end 105*b* according to the magnitude of the pressing force from the head 101 transmitted via the vibration sensor 103 to transmit the pressing force to the pressure sensor 106. In view of this, the pressure sensor 106 outputs the detection signal corresponding to an area pressed by the end 105*b* of the pressure sensor pressing body 105 to the signal processing device 110. Accordingly, the signal processing device 110 generates the musical sound signal representing the musical sound based on the detection signal output from the vibration sensor 103. Furthermore, the signal processing device 110 changes this musical sound signal using the detection signal output from the pressure sensor 106 to output the musical sound signal to the external speaker. Consequently, the electronic percussion 100 can output the musical sound corresponding to the performance operation by the player from the external speaker.

As can be understood from the explanation on the operation, with the embodiment, the vibration sensor 103 and the pressure sensor 106 are disposed indirectly stacked between the head 101 and the bottom 102*a* of the trunk 102 via the pressure sensor pressing body 105 in the electronic percussion 100. This ensures detecting the vibration and the pressure change occurred in the head 101 by the hitting operation by the player at the positions on the identical line under the struck surface 101*a*. In view of this, the reproduction of further faithful musical sound relative to the hitting operation by the player is possible.

Furthermore, the implementation of the present invention is not limited to the above-described embodiment, and various modifications are possible without departing from the object of the present invention. Like reference numerals designate corresponding or identical elements throughout the embodiment and the following respective modifications, and therefore such elements will not be further elaborated here.

For example, with the embodiment, the pressure sensor pressing body 105 is formed such that an area of the end 105*b* on the side of pressing the pressure sensor 106 is smaller than the pressure-receiving area in the pressure sensor 106. This prevents the electronic percussion 100 from saturating the detected value of the pressure sensor 106 simultaneously with the input of the pressure. The pressure sensor pressing body 105 is constituted of the elastic body. In view of this, the increase in the contacted area of the end 105*b* with the pressure sensor 106 according to the pressure can improve a detection width (so-called dynamic range) and detection resolution of the pressure.

With the pressure sensor pressing body 105, an area of the one end 105*b* at a side pressing the pressure sensor 106 is formed smaller than an area of the end 105*a* at the other side, which is a side opposite to this end 105*b*. This allows the electronic percussion 100 to detect the slight warp and deformation of the head 101 by a wide region and to concentratedly transmit the warp and the deformation to the pressure sensor 106. This ensures improving the detection accuracy of the pressure.

Figure 5:
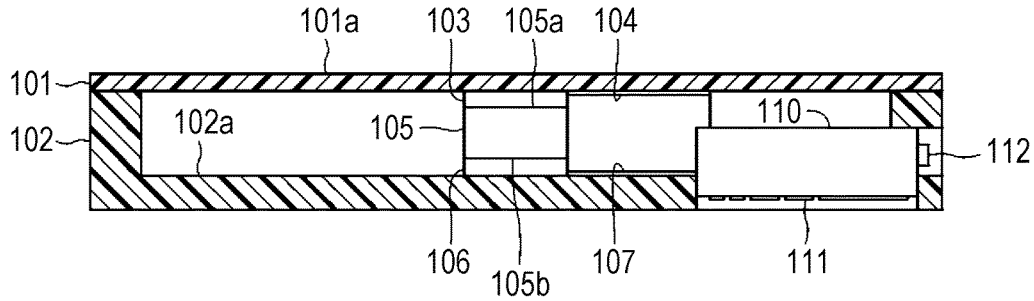
FIG. 5 is a cross-sectional view schematically illustrating a schematic internal configuration of an electronic percussion according to a modification of the present invention.

Note that it is only necessary that the pressure sensor pressing body 105 is disposed on the side opposite to the vibration sensor 103 with respect to the pressure sensor 106 and is formed into a shape with which the pressure sensor pressing body 105 can support the pressure sensor 106. Accordingly, as illustrated in FIG. 5, for example, the pressure sensor pressing body 105 can be formed to have a pillar shape such as a columnar shape or a prismatic shape with a constant area on the one end 105*b* side, the side of pressing the pressure sensor 106, and on the other end 105*a* side. The pressure sensor pressing body 105 can be made of, in addition to the elastic material such as a rubber material and a urethane resin material a material without elasticity, for example, a hard resin material such as a POM material and a metallic material. The area of the end 105*a* on the vibration sensor 103 side of the pressure sensor pressing body 105 is preferably formed to have the area equal to or less than the area of the vibration sensor 103.

With the embodiment, the pressure sensor pressing body 105 is disposed between the vibration sensor 103 and the pressure sensor 106, and the pressure sensor 106 is disposed on the bottom 102*a* of the trunk 102. Accordingly, the electronic percussion 100 can fix the signal line 107 of the pressure sensor 106 to the bottom 102*a*. Furthermore, a signal line secured to the back surface of the head 101 can be configured of only the signal line 104 of the vibration sensor 103. This can prevent these members from becoming an obstacle of the vibration and the warp and the deformation of the head 101 and a source of generating abnormal noise.

Figure 6:
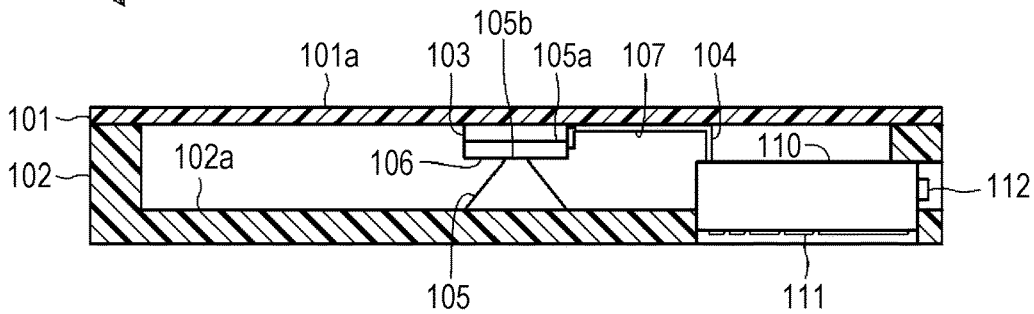
FIG. 6 is a cross-sectional view schematically illustrating a schematic internal configuration of an electronic percussion according to another modification of the present invention.

Note that it is only necessary that the pressure sensor pressing body 105 is formed so as to press the pressure sensor 106 according to the warp and the deformation of the head 101. Accordingly, for example, as illustrated in FIG. 6, the pressure sensor pressing body 105 can be disposed between the bottom 102*a* of the trunk 102 and the pressure sensor 106. In this case, the pressure sensor 106 is fixedly secured to the surface of the vibration sensor 103 on the side opposite to the fixedly-secured surface of the vibration sensor 103 with the head 101. Therefore, with the electronic percussion 100, the signal line 104 of the vibration sensor 103 and the signal line 107 of the pressure sensor 106 can be collectively wired in the signal processing device 110. This facilitates matching between the vibration sensor 103 and the pressure sensor 106. Furthermore, the device configuration is simplified, ensuring facilitating the assembly work and the maintenance.

With the embodiment, the pressure sensor pressing body 105 is not fixedly secured to but in contact with the surface of the pressure sensor 106. Accordingly, even if a force of separating the pressure sensor pressing body 105 from the pressure sensor 106 acts on the pressure sensor pressing body 105, the electronic percussion 100 prevents the pressure sensor pressing body 105 from pulling the pressure sensor 106. This ensures preventing damage of the pressure sensor 106 and also ensures improving the detection accuracy of the pressure. Note that the pressure sensor pressing body 105 can be disposed to the surface of the pressure sensor 106 fixedly secured using an adhesive material, the double-sided adhesive tape, or the like.

Figure 7:
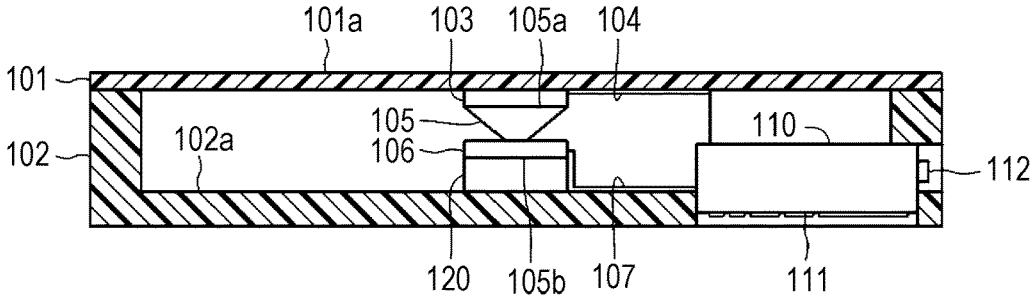
FIG. 7 is a cross-sectional view schematically illustrating a schematic internal configuration of an electronic percussion according to another modification of the present invention.

With the embodiment, the pressure sensor 106 is supported on the bottom 102*a* of the trunk 102. That is, the bottom 102*a* is equivalent to a pressure sensor supporting body according to the present invention. Note that it is only necessary that the pressure sensor supporting body is disposed on the side opposite to the vibration sensor 103 with respect to the pressure sensor 106 and supports the pressure sensor 106. Accordingly, for example, as illustrated in FIG. 7, the pressure sensor 106 can be disposed on the bottom 102*a* via a pressure sensor receiving body 120.

In this case, the pressure sensor receiving body 120 is a component to elastically support the pressure sensor 106. The pressure sensor receiving body 120 can be constituted by forming the elastic body such as the rubber material and the urethane resin material into the plate shape or the columnar shape. Additionally, the pressure sensor 106 is fixedly secured on the one (the upper side in the drawing) end surface of the pressure sensor receiving body 120 with the adhesive material, the double-sided adhesive tape, or the like. In this state, the other (the lower side in the drawing) end surface of the pressure sensor receiving body 120 is fixedly secured on the bottom 102*a* using the adhesive material, the double-sided adhesive tape, or the like.

According to this, with the electronic percussion 100, the pressure sensor 106 is elastically supported by the pressure sensor receiving body 120. This ensures protecting the pressure sensor 106 against the vibration and the impact from the bottom 102*a* side, ensuring improving the detection accuracy of the pressure. With the electronic percussion 100, differentiating the elastic force of the pressure sensor pressing body 105 and the elastic force of the pressure sensor receiving body 120 from one another allows changing the detection property of the pressure by the pressure sensor 106.

Figure 8:
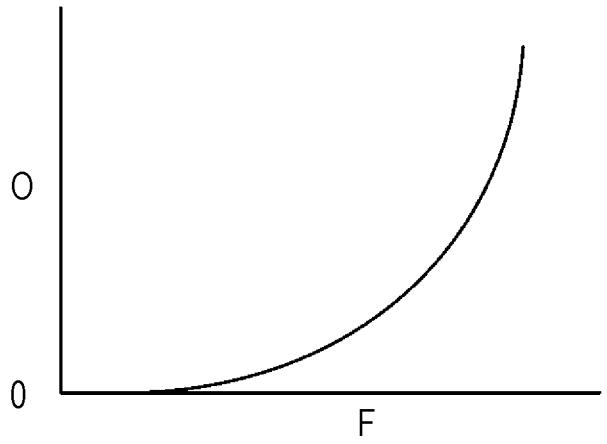
FIG. 8 is a graph schematically illustrating a magnitude relationship between a pressing force F from the head and an output O of a detection signal from the pressure sensor in the case where an elastic modulus (force/distortion) of the pressure sensor pressing body is higher than an elastic modulus of a pressure sensor receiving body in the electronic percussion illustrated in FIG. 7.

For example, with the electronic percussion 100, in the case where an elastic modulus (force/distortion) of the pressure sensor pressing body 105 is higher than an elastic modulus of the pressure sensor receiving body 120 (in other words, in the case where a rigidity of the pressure sensor pressing body 105 is high), as illustrated in FIG. 8, an output O of the detection signal from the pressure sensor 106 relative to a pressing force F received from the head 101 becomes insensitive at an early stage where the pressing force F is small.

Figure 9:
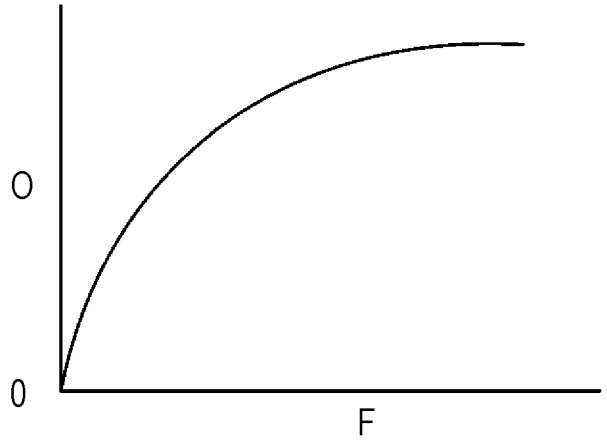
FIG. 9 is a graph schematically illustrating the magnitude relationship between the pressing force F from the head and the output O of the detection signal from the pressure sensor in the case where the elastic modulus (force/distortion) of the pressure sensor pressing body is lower than the elastic modulus of the pressure sensor receiving body in the electronic percussion illustrated in FIG. 7.

On the other hand, for example, with the electronic percussion 100, in the case where the elastic modulus (force/distortion) of the pressure sensor pressing body 105 is lower than the elastic modulus of the pressure sensor receiving body 120 (in other words, in the case where a rigidity of the pressure sensor receiving body 120 is high), as illustrated in FIG. 9, the output O of the detection signal from the pressure sensor 106 relative to the pressing force F received from the head 101 becomes insensitive at a later stage where the pressing force F is large.

Figure 10:
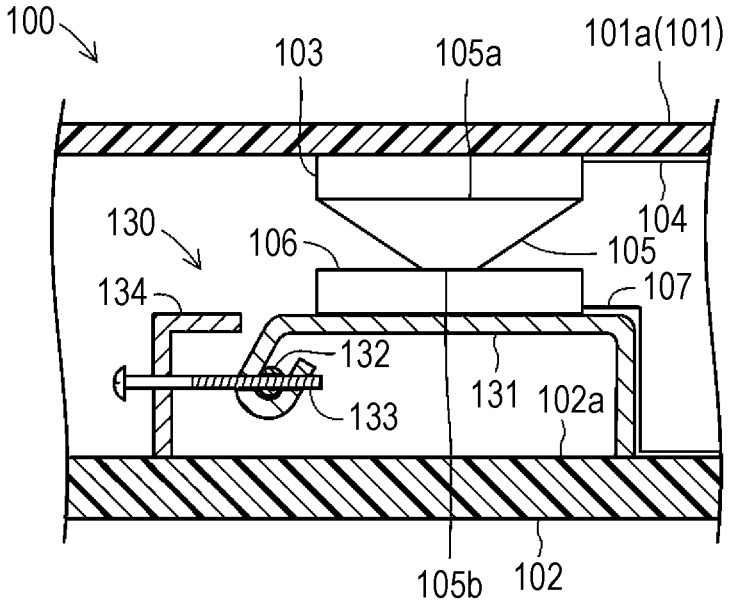
FIG. 10 is a partial cross-sectional view schematically illustrating a configuration of main parts inside an electronic percussion according to another modification of the present invention.

For example, as illustrated in FIG. 10, the pressure sensor 106 can be disposed on the bottom 102*a* via a displacement mechanism 130. The displacement mechanism 130 is a component to change a distance between the pressure sensor 106 and the pressure sensor pressing body 105. The displacement mechanism 130 is configured so as to mainly include a warp base 131, an adjusting screw 133, and a screw supporting body 134.

The warp base 131 is a component that supports the pressure sensor 106. After standing from the bottom 102*a*, the warp base 131 formed of a metal plate is bent in a right angle direction (a horizontal direction in the drawing). The pressure sensor 106 is fixedly secured to a part of this warp base 131 extending in the horizontal direction in the drawing opposed to the pressure sensor pressing body 105. Furthermore, after additionally bent to the bottom 102*a* side, the distal end of the warp base 131 holds a pin body 132 to be slidably movable.

The adjusting screw 133 is a component to warp and deform the warp base 131. The adjusting screw 133 supported to the screw supporting body 134 is fitted to the pin body 132 with the screw. The screw supporting body 134 is a component to support the adjusting screw 133. The screw supporting body 134 is formed of a metal plate stood from the bottom 102*a*.

Figure 11:
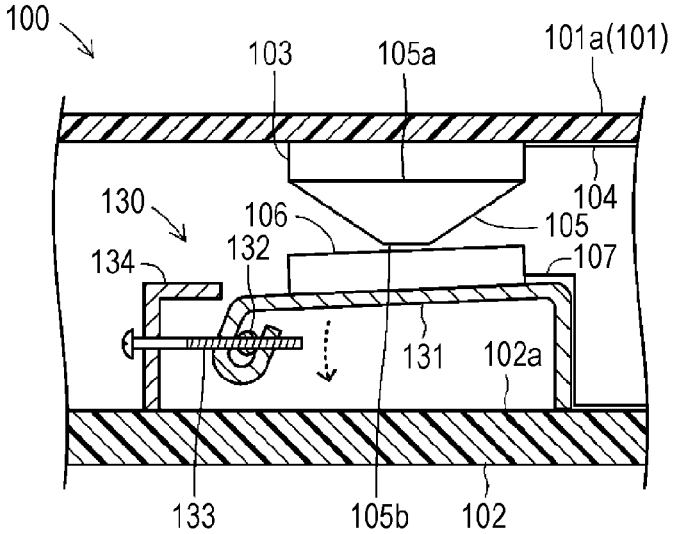
FIG. 11 is a partial cross-sectional view illustrating a state where a warp base of a displacement mechanism in the electronic percussion illustrated in FIG. 10 warps.

An adjuster desiring to change the distance between the pressure sensor 106 and the pressure sensor pressing body 105 operates the displacement mechanism 130 thus configured. The adjuster is, for example, a manufacturer or the player of the electronic percussion 100. Specifically, as indicated by the dashed arrow in FIG. 11, the adjuster performs a rotation operation on the adjusting screw 133 to press the distal end of the warp base 131. The adjuster thus warps and deforms the warp base 131 such that the pressure sensor 106 can be separated from the pressure sensor pressing body 105.

Figure 12:
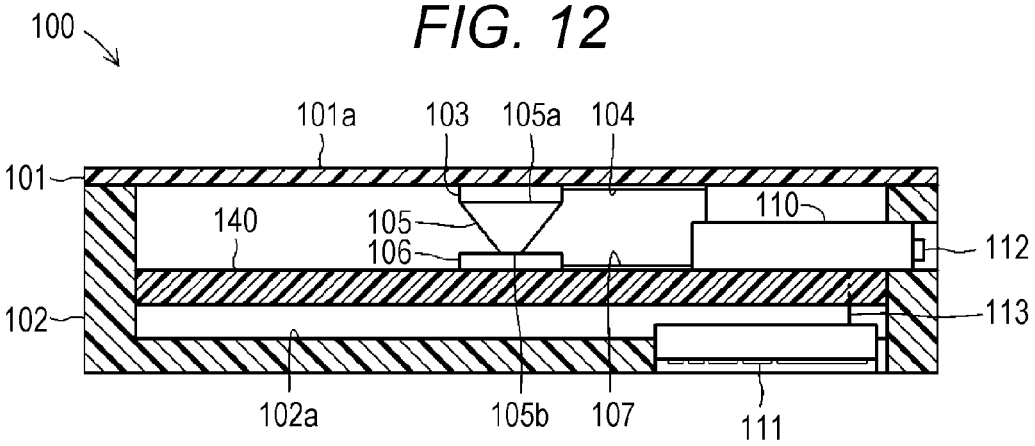
FIG. 12 is a cross-sectional view schematically illustrating a schematic internal configuration of an electronic percussion according to another modification of the present invention.

The pressure sensor supporting body supporting the pressure sensor 106 is not necessary to be the bottom 102*a* of the trunk 102. It is only necessary that the pressure sensor supporting body is disposed on the side opposite to the vibration sensor 103 with respect to the pressure sensor 106 so as to support the pressure sensor 106. Accordingly, for example, as illustrated in FIG. 12, the pressure sensor supporting body can be constituted of a beam-shaped supporting body 140 bridged in a space inside the trunk 102. According to this, the supporting body 140 is disposed bridged in the space inside the trunk 102. In view of this, the supporting body 140 can protect the pressure sensor 106 against the vibration and the impact received from the bottom 102*a*. This ensures improving the detection accuracy of the pressure. In this case, the operation panel 111 is constituted of a different body electrically connected to the signal processing device 110 by a cable 113 and can be exposed to the lower surface of the bottom 102*a* of the trunk 102.

Figure 13:
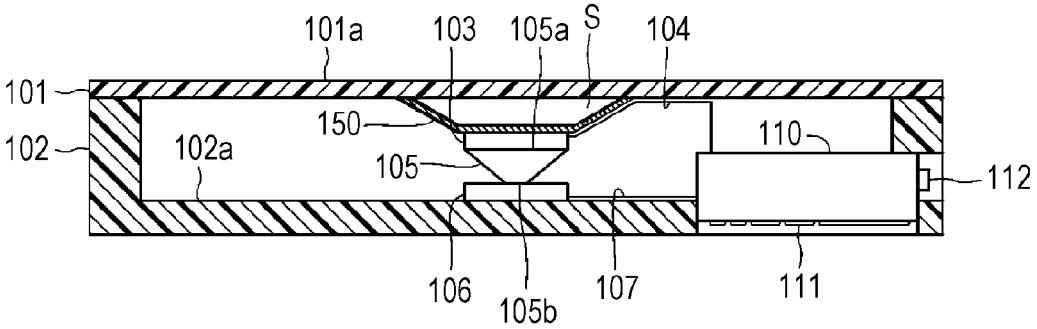
FIG. 13 is a cross-sectional view schematically illustrating a schematic internal configuration of an electronic percussion according to another modification of the present invention.

With the embodiment, the vibration sensor 103 is disposed fixedly secured directly to the back surface of the head 101. Note that it is only necessary that the vibration sensor 103 is disposed such that the vibration of the head 101 can be detected. Accordingly, for example, as illustrated in FIG. 13, the vibration sensor 103 can be disposed to the back surface of the head 101 via a vibration sensor supporting body 150.

In this case, the vibration sensor supporting body 150 is a component to indirectly support the vibration sensor 103 to the head 101. The vibration sensor supporting body 150 is constituted by forming a metal plate into a cylinder with a closed bottom. In other words, the vibration sensor supporting body 150 supports the vibration sensor 103 to the back surface of the head 101 via a space S. Accordingly, when the player beats the proximity of the vibration sensor 103 including the right above the vibration sensor 103 on the struck surface 101*a*, the electronic percussion 100 can restrain the damage of the vibration sensor 103 and also can prevent deterioration of the detection accuracy. The vibration sensor supporting body 150 can also be constituted by forming the elastic body such as the rubber material and the urethane resin material into the plate shape or the columnar shape.

With the embodiment, the vibration sensor 103 is disposed at the center of the head 101, which is formed into the circular shape in a plan view. Note that it is only necessary that the vibration sensor 103 is disposed such that the vibration sensor 103 can detect the vibration of the head 101. In view of this, the vibration sensor 103 can be disposed at a position other than the center, for example, an edge portion or an intermediate portion between the center and the edge portion on the head 101. Obviously, in these cases, the pressure sensor 106 is disposed at the position opposed to the vibration sensor 103. Note that disposing the pressure sensor 106 opposed to the vibration sensor 103 does not always mean that center axes of both are on the identical line. There may be a case where the center of the pressure sensor 106 is displaced with respect to the center of the vibration sensor 103. A plurality of the vibration sensors 103 can also be disposed at the head 101.

With this embodiment, the electronic percussion 100 is constituted of the electronic drum. Note that the electronic percussion 100 is widely applicable to an electronic musical instrument that detects the vibration and the pressure change on the struck surface when the struck surface is beaten and rubbed by the hand, the stick, or the like to generate the electronic musical sound. Accordingly, the electronic percussion 100 can be configured as an electronic cymbals, high-hat cymbals, and percussion.

DESCRIPTION OF REFERENCE SIGNS

F: Pressing force from head
O: Magnitude of detection signal of pressure sensor
S: Space
100: Electronic percussion
101: Head
101*a*: Struck surface
102: Trunk
102*a*: Bottom
103: Vibration sensor
104: Signal line
105: Pressure sensor pressing body
105*a*, 105*b*: End
106: Pressure sensor
107: Signal line
110: Signal processing device
111: Operation panel
112: Output terminal
113: Cable
120: Pressure sensor receiving body
130: Displacement mechanism
131: Warp base
132: Pin body
133: Adjusting screw
134: Screw supporting body
150: Vibration sensor supporting body

The invention claimed is:

1. An electronic percussion comprising:

a head constituting a struck surface beaten by a player;

a vibration sensor disposed at a back surface side opposite to the struck surface at the head, the vibration sensor being configured to detect a vibration of the head;

a pressure sensor disposed opposed to the vibration sensor at a side opposite to the head, the pressure sensor being configured to detect a pressure received by the head;

a pressure sensor supporting body disposed at a side opposite to the vibration sensor with respect to the pressure sensor, the pressure sensor supporting body supporting the pressure sensor; and a pressure sensor pressing body disposed between the vibration sensor and the pressure sensor or between the pressure sensor and the pressure sensor supporting body, the pressure sensor pressing body pressing the pressure sensor.

2. The electronic percussion according to claim 1, wherein the pressure sensor pressing body is constituted of an elastic body that elastically deforms according to a pressure.

3. The electronic percussion according to claim 1, wherein the pressure sensor pressing body has an area of a part pressing the pressure sensor smaller than an area of the pressure sensor.

4. The electronic percussion according to claim 1, wherein the pressure sensor pressing body has an area of one end at a side pressing the pressure sensor smaller than an area of an end at another side, the other side being the vibration sensor side or the pressure sensor supporting body side.

5. The electronic percussion according to claim 1, wherein the vibration sensor and the pressure sensor are disposed at a center of the head.

6. The electronic percussion according to claim 1, wherein the pressure sensor pressing body is not fixedly secured to but in contact with a surface of the pressure sensor.

7. The electronic percussion according to claim 1, wherein:

the pressure sensor pressing body is disposed between the vibration sensor and the pressure sensor, and between the pressure sensor and the pressure sensor supporting body, a pressure sensor receiving body is provided, the pressure sensor receiving body being constituted of an elastic body that elastically deforms according to a pressure.

8. The electronic percussion according to claim 1, wherein the vibration sensor is supported by a vibration sensor supporting body, the vibration sensor being separated from the head.

9. The electronic percussion according to claim 1, wherein the pressure sensor supporting body includes a displacement mechanism that changes a distance between the pressure sensor pressing body and the pressure sensor.

* * * * *